US009591725B2

(12) United States Patent
Radermacher

(10) Patent No.: US 9,591,725 B2
(45) Date of Patent: Mar. 7, 2017

(54) LIGHT EMITTING DEVICE SYSTEM COMPRISING A REMOTE CONTROL SIGNAL RECEIVER AND DRIVER

(75) Inventor: Harald Josef Günther Radermacher, Aachen (DE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 819 days.

(21) Appl. No.: 13/259,165

(22) PCT Filed: Mar. 15, 2010

(86) PCT No.: PCT/IB2010/051095

§ 371 (c)(1),
(2), (4) Date: Jan. 4, 2012

(87) PCT Pub. No.: WO2010/109366

PCT Pub. Date: Sep. 30, 2010

(65) Prior Publication Data

US 2012/0091902 A1 Apr. 19, 2012

(30) Foreign Application Priority Data

Mar. 24, 2009 (EP) ..... 09155948

(51) Int. Cl.
*H05B 37/02* (2006.01)

(52) U.S. Cl.
CPC ..... *H05B 37/0272* (2013.01)

(58) Field of Classification Search
CPC H05B 37/02; H05B 37/0227; H05B 37/0272; H05B 37/0245; H05B 37/0263; H05B 37/036; H05B 37/04
USPC ... 315/149, 159, 160, 227 R, 228, 246, 294, 315/308
See application file for complete search history.

(56) References Cited

U.S. PATENT DOCUMENTS

| | | | | |
|---|---|---|---|---|
| 5,099,193 | A * | 3/1992 | Moseley et al. | 323/324 |
| 5,637,964 | A * | 6/1997 | Hakkarainen et al. | 315/295 |
| 5,905,442 | A * | 5/1999 | Mosebrook et al. | 340/3.7 |
| 5,909,087 | A * | 6/1999 | Bryde | H05B 37/0263 315/149 |
| 6,380,696 | B1 | 4/2002 | Sembhi et al. | |

(Continued)

FOREIGN PATENT DOCUMENTS

| | | |
|---|---|---|
| CN | 1980514 A | 6/2007 |
| EP | 2088836 A1 | 8/2009 |

(Continued)

OTHER PUBLICATIONS

Webster's New Twentieth Century Dictionary, Unabridged Second Edition, Simon and Schuster, 1983, p. 595.*

*Primary Examiner* — Thai Pham
(74) *Attorney, Agent, or Firm* — Meenakshy Chakravorty

(57) ABSTRACT

The invention relates to a light emitting device system (112) comprising power supply terminals (114) and a remote control signal receiver (118), the power supply terminals being adapted for receiving electrical power from an external driver (100), the remote control signal receiver (118) being adapted for receiving a remote control signal, wherein the light emitting device system (112) is further adapted for providing the received remote control signal as remote control signal information exclusively via the power supply terminals (114) and/or via wireless transmission to the driver (100).

20 Claims, 5 Drawing Sheets

(56) References Cited

U.S. PATENT DOCUMENTS

2002/0048169 A1 4/2002 Dowling et al.
2004/0105264 A1 6/2004 Spero
2006/0062582 A1* 3/2006 Suzuki ..... H04B 10/502 398/183
2007/0091597 A1 4/2007 Wang et al.
2007/0285031 A1* 12/2007 Shteynberg et al. ..... 315/294
2008/0092800 A1 4/2008 Smith et al.
2008/0129220 A1* 6/2008 Shteynberg et al. ..... 315/291
2008/0200119 A1* 8/2008 Onishi et al. ..... 455/41.1
2008/0284356 A1 11/2008 Yuen
2009/0021955 A1 1/2009 Kuang et al.
2009/0059603 A1 3/2009 Recker et al.
2010/0103665 A1* 4/2010 Mubaslat ..... H05B 33/0887 362/234
2010/0141153 A1* 6/2010 Recker ..... H05B 33/0803 315/149
2011/0236034 A1* 9/2011 Schenk ..... H05B 33/0809 398/201
2012/0051757 A1* 3/2012 Nishino ..... H04B 10/1149 398/201
2012/0328299 A1* 12/2012 Pickard ..... H04B 10/116 398/106

FOREIGN PATENT DOCUMENTS

GB 2397942 A 8/2004
JP 3172092 A 7/1991
JP 6310284 A 11/1994
JP 2002247667 A 8/2002
JP 2002289372 A 10/2002
JP 2008098116 A 4/2008
JP 2008204922 A 9/2008
WO WO2006056960 * 6/2006 ..... H05B 33/08
WO 2007089581 A2 8/2007
WO WO2008001274 * 1/2008
WO WO2008200119 * 8/2008 ..... H04B 5/00

* cited by examiner

LIGHT EMITTING DEVICE SYSTEM COMPRISING A REMOTE CONTROL SIGNAL RECEIVER AND DRIVER

TECHNICAL FIELD

The invention relates to a light emitting device system comprising a remote control signal receiver, and the invention relates to a driver for an external light emitting device system, and the invention further relates to an external control system.

BACKGROUND AND RELATED ART

Solid state light (SSL) sources such as but not limited to light emitting diodes (LEDs) will play an increasingly significant role in general lighting in the future. This will result in more and more new installations being equipped with LED light sources in various ways. The reason for replacing state of the art light sources with LED light sources is e.g. the low power consumption of LED light sources and their extremely long lifetime.

Typically, an LED is driven by means of a special circuit, which is called the driver. To control the LED light source for example with respect to color or light intensity a user may have a remote control to select certain light emission characteristics. It is also possible that the remote control signals are generated by a technical system which controls the lamps in a certain location (e.g. a room).

For example, US 2008/0284356 A1 discloses a remote-dimmable energy saving device which comprises a remote control transmitter and a dimmable electronic ballast with a built-in remote control receiver.

SUMMARY OF THE INVENTION

The present invention provides a light emitting device system comprising power supply terminals and a remote control signal receiver, the power supply terminals being adapted for receiving electrical power from an external driver, the remote control signal receiver being adapted for receiving a remote control signal, wherein the light emitting device system is further adapted for providing the received remote control signal as remote control signal information exclusively via the power supply terminals and/or via wireless transmission to the driver.

In state of the art systems, a remote control of LED systems requires that the LED driver and the LED lamp are provided as one physical unit together with a remote control sensor which, by special internal wiring, allows to provide detected remote control signals directly to the driver such that in turn the driver is able to appropriately adjust the characteristics of the power supplied to the LED lamp. As a consequence, such a system lacks the ability to provide the LED lamp independently of the driver.

In further state of the art systems, a remote control of LED systems requires the use of an extra receiver that has to be put somewhere on or next to the luminaire and is connected to the driver by means of additional wires. As a consequence, such a system lacks the ability to provide the remote control functionality by simply retrofitting an existing luminaire with a new LED lamp and a driver, as changes to the wiring or even drilling holes into the luminaire to run the wires trough the luminaire are required.

In contrast, according to the invention a remote control receiver is provided together with the light emitting device system, and the remote control signals received by said receiver are forwarded as remote control signal information via the power supply terminals and/or via wireless transmission to the driver. Since the power supply terminals themselves and/or a wireless transmission is used for communication of information to the driver, no additional wiring in the luminaire is required. This has various advantages: a first advantage is that the light emitting device system is compatible even with 'low end' drivers which do not support control of the light emitting device system via remote control signals. In this case, the driver will simply ignore the information provided via the power supply terminals and/or via wireless transmission. A second advantage is that due to the fact that no additional wiring in the luminaire is required, no additional technical and electrical approval of a light emitting device system and driver is necessary. Such a technical approval is typically provided by certain federal or state organizations and involves an extensive procedure of device testing, which is quite cost intensive and time consuming. By virtue of the light emitting device system according to the invention, no special technical approval is required.

It has to be noted that throughout the description a light emitting device system is understood as a solid state light system, comprising for example at least one OLED lamp, one LED lamp or laser lamp.

In accordance with an embodiment of the invention, the remote control signal receiver is spatially located in a surface area of the light emitting device system facing in the direction of the illumination beam path of the light emitting device system. For example, the remote control signal receiver is spatially located in the illumination beam path of the light emitting device system. A further example is that the remote control signal receiver may be hidden in the LED lamp optics or the remote control signal receiver may be located on the LED system board facing in the direction of the illumination beam path of the light emitting device system. In the latter case, the remote control signal receiver is located behind the LED in a location opposite to the light radiating surface of the light emitting device system.

In all embodiments the LED lamp can suitably accommodate the remote control signal receiver, since usually the LED device is positioned in a place where electromagnetic waves, such as light, can leave the luminaire. Hence, remote control signals can use the same path to reach the LED lamp.

In case in conventional devices with a separate driver and LED system, a control of the LED system is desired, a respective remote control signal receiver would need to be electrically connected to the driver which could be realized either by mounting a certain remote control signal receiver inside the housing in which the driver is mounted or by placing a sensor somewhere on the surface of the driver housing. However, the housing of the driver may shield remote control signals, especially when a metal housing is used. Further, an external sensor may disturb the design of the luminaire and, even worse, such a sensor has to be connected to the driver, requiring an additional wiring effort. Depending on the galvanic isolation of the driver, the sensor and the wiring may even be live parts and require safe isolation.

All these problems can be solved by placing the remote control signal receiver in the light emitting device system, preferably so as to face in the direction of the illumination beam path of the light emitting device system.

In accordance with an embodiment of the invention, the light emitting device system further comprises an optical lens, wherein the remote control signal receiver is located on the optical axis of said lens. Preferably, the sensor is located on the surface of the lens, for example on the inner or outer lens surface. In both cases, the sensor may comprise on its backside facing away from the direction of the illumination beam path of the light emitting device system a light reflecting area such that light is reflected back towards the inside of the light emitting device system. This special arrangement may be used for example in combination with a parabolic mirror located around the solid state light source and facing in the direction of the illumination beam path of the light emitting device system to provide light emission with a certain optical geometry, like for example a spot-like light emission.

In the case of RF signal reception, the functionality of the electrical signal reception (antenna) and the functionality of the optical light reflection can be combined into just one component.

In general, the remote control signal receiver may be located on the optical axis of said lens within the light emitting device system, i.e. not on the lens itself. In this case, the lens may be a diffuser, so that due to the presence of the remote control signal receiver on the optical axis, shadowing of the light on the optical axis is provided. Nevertheless, by appropriately selecting the distance between the solid state light source, the shadowing remote control signal receiver and the diffuser, a highly homogeneous light emission over the whole diffuser can be obtained.

In accordance with a further embodiment of the invention, the light emitting device system is adapted for providing the received remote control signal as remote control signal information via the power supply terminals to the driver by emulating an electrical load of the light emitting device system, depending on the received remote control signal. This has the advantage that without the need for any additional wiring between the driver and the LED system or any other wireless transmission techniques the driver can be notified about the received remote control signal to dynamically adjust the electrical power provided to the light emitting device system, depending on the remote control signals received by the light emitting device system, or to forward the remote control signal to a superordinate control network, or a combination of both.

Since the remote control signal information of the light emitting device system is supplied only via the supply terminals, no additional signal connections like for example extra pins are required for signaling information from the light emitting device system to the driver. As a consequence, for example the risk of malfunction of the light emitting device system due to loose contacts is reduced. Further, this allows for the provision of light emitting device systems at lower cost and even miniaturized dimensions.

In accordance with an embodiment of the invention, the light emitting device system is operable for light emission by sequentially receiving electrical power having a first or a second power signal characteristic, wherein the light emitting device system further comprises an emulation circuit adapted for emulating the electrical load, wherein the emulation circuit is adapted to emulate the electrical load with a higher effectiveness when receiving the electrical power having the second power signal characteristic than when receiving the electrical power having the first power signal characteristic. Here, power signal characteristic is understood as any physical characteristic of the power signal itself. Such a characteristic may for example comprise: polarity, voltage, current, phasing, frequency, or waveform, or any combination thereof. For example, it is possible to supply a DC signal as the first power signal characteristic and to supply the DC signal with a superimposed AC signal as the second power signal characteristic.

For example, the electrical power may be received sequentially as an alternating current in a first and second frequency range, wherein a detector circuit of the driver is adapted for capturing the remote control signal information of the light emitting device system only in the second frequency range, the first frequency range being different from the second frequency range.

According to an advantageous embodiment, in case the electrical power is supplied to the light emitting device system by the alternating current in the first frequency range, the emulation circuit of the light emitting device system will not be active during said power provision in the first frequency range. Preferably, the emulation circuit is adapted for causing significant loading of the power supply terminals only in a second frequency range. This could be achieved by means of a bandpass filter-like behavior of the emulation circuit. During time intervals when this second frequency range is not excited by the driver, the circuit has nearly no effect on the power flow between the driver and the light emitting diode device system.

In a further example, the provision of the supplied power to the light emitting device system is only performed at certain time intervals in the second frequency range and during the rest of the time in the first frequency range, such that in between the time intervals the emulation circuit of the light emitting device system will not unnecessarily consume electrical power since it does not respond to the first frequency range. Only at said certain time intervals, the driver switches the provision of the alternating current from the first to the second frequency range and in turn the driver will capture remote control signal information of the light emitting device system. Only in this case the emulation circuit of the light emitting device system becomes 'active' i.e. resonant and influences the power flow, e.g. by consuming some energy. As a further consequence, the emulation circuit of the light emitting device system can be passively turned on and off.

A further advantage of the usage of different frequency ranges is that a more intelligent light emitting device system may detect, by means of sensing in the relevant frequency range, whether it is powered from a driver which supports the novel signaling method by capturing remote control signal information of the light emitting device system in a certain frequency range.

Instead of passive circuits like inductor and capacitor-based resonant tanks to have a supply signal characteristics dependency of the effectiveness of the impedance emulation, also the remote control signal receiver in the light emitting device system may detect the actual power supply characteristics and activate or deactivate the emulation accordingly.

In accordance with a further embodiment of the invention, the electrical load of the light emitting device system is emulated with respect to an external potential, wherein said external potential is different from the potential of the power supply terminals. For example, the potential may be ground potential. However, the coupling to any other component which is not at ground potential could be modulated depending on the received remote control signal. For example, an external reflector of the light emitting device system may be the reference potential, wherein this reflector is electrically coupled to the external driver.

As a consequence, it is possible for the driver to make use of common mode effects to detect sensed information. In such an embodiment, the 'parasitic' capacity of the light emitting device system with respect to the external potential is utilized. Such an embodiment could also comprise a light emitting diode unit with two power supply terminals and a metal housing for cooling. The remote control signal receiver in the light emitting diode unit is adapted to influence the coupling between the power supply terminals and the metal housing.

In another aspect, the invention relates to a driver for an external light emitting device system comprising power supply terminals and a detector circuit, the power supply terminals being adapted for supplying electrical power from the driver to the light emitting device system and the detector circuit being adapted for capturing remote control signal information of the light emitting device system exclusively via the supply terminals and/or via wireless reception and for determining a remote control signal received by a light emitting device system using the remote control signal information, wherein the driver is further adapted to control the supplied power depending on the determined remote control signal.

In accordance with an embodiment of the invention, the detector circuit is adapted for capturing the remote control signal information of the light emitting device system exclusively via the supply terminals by sensing an electrical load of the terminals caused by the light emitting device system. The light emitting device system comprises at least one remote control signal receiver which can detect a certain remote control signal provided to the light emitting device system. This remote control signal is encoded as remote control signal information in a certain impedance which is emulated by the light emitting device system to the driver.

In accordance with a further embodiment of the invention, the remote control signal information is comprised in a sequence of impedances emulated by the light emitting device system and captured by the detector circuit by the sensing of the electrical load of the terminals caused by the light emitting device system. In this case, even complex digital encoding of the remote control signal information can be provided by means of the sequence of impedances emulated by a light emitting device system. For example, the impedance of the light emitting device system is modulated by the remote control signal information. However, in general, in case digital information has to be provided this can be performed by any impedance modulation, which does not necessarily have to be performed by means of a sequence of impedances.

In general, including the remote control signal information in the impedance emulated by the light emitting device system has the advantage of a rather simple and cost effective technical implementation. For example, a simple resistor could be used which is turned on and off for modulating the electrical load of the light emitting device system. In a more complex version, the resistor may be a tunable resistor, wherein the light emitting device system performs a time-dependent tuning and/or turning on and off of the resistor in order to provide an electrical load to the driver in a dynamic way.

Further, an advantage of the emulation of the impedance is that such emulation can be designed so as to have no significant influence on the power path of the light emitting device system.

In accordance with an embodiment of the invention, electrical power having a first and second power signal characteristic is supplied sequentially to the light emitting device system, wherein the detector circuit is adapted for capturing the remote control signal information of the light emitting device system only during provision of the electrical power having the second power signal characteristic, the first power signal characteristic being different from the second power signal characteristic.

In accordance with an embodiment of the invention, the driver is adapted for switching between a first and second operation mode, wherein in the first operation mode the driver is adapted to supply power to the light emitting device system by the alternating current in the first frequency range and the detector circuit is disabled, and wherein in the second operation mode the driver is adapted to supply power to the light emitting device system by an alternating current in the second frequency range and the detector is enabled for capturing the remote control signal information of the light emitting device system. As mentioned above, this allows for a further reduction of the driver's power consumption, since the driver only actively captures the remote control signal information of the light emitting device system in case the alternating current is provided to the light emitting device system in the second frequency range.

It has to be noted that preferably any of the user frequencies including the first and second frequency ranges are so high that the user of the light emitting device system will not be able to see a distortion, e.g. optical flicker during operation in a frequency range or during transition between the different frequency ranges in which the electrical power is supplied to the light emitting device system and which cause a light emitting diode to be turned on and off in accordance with the actual current direction.

In accordance with an embodiment of the invention, the detector circuit is adapted for capturing the remote control signal information of the light emitting device system by demodulating the impedance emulated by the light emitting device system.

In accordance with a further embodiment of the invention, the driver is further adapted to provide the remote control signal information to an external control system and to receive a control command from the external control system in response to the provision of the remote control signal information. The driver is adapted to control the supplied power, depending on the control command. For example, the external control system may be a superordinate control network like for example a DALI network. DALI stands for Digital Addressable Lighting Interface and is a protocol set out in the technical standard IEC 62386. By means of such a superordinate control network, it is possible to have full control even over a complex system comprising a multitude of light emitting diode units. This is especially valuable for parameters like for example the temperature of the light emitting diode lamps, which could be monitored, or the burning hours to replace the lamps after a certain time.

In another aspect, the invention relates to an external control system, wherein the external control system is adapted to be connected to a first and a second driver, the external control system being further adapted for receiving first remote control signal information from the first driver and in response to said reception providing second remote control signal information to the second driver. This has the advantage that remote control signal information captured by the first driver can be used to control the power supplied by the second driver. For example, for this purpose the external control system may only forward the remote control signal information to the second driver or the external control system may process the remote control signal information and provide different remote control signal information to the second driver.

BRIEF DESCRIPTION OF THE DRAWINGS

In the following, preferred embodiments of the invention are described in greater detail by way of example only, with reference to the drawings, in which.

DETAILED DESCRIPTION

Figure 1:
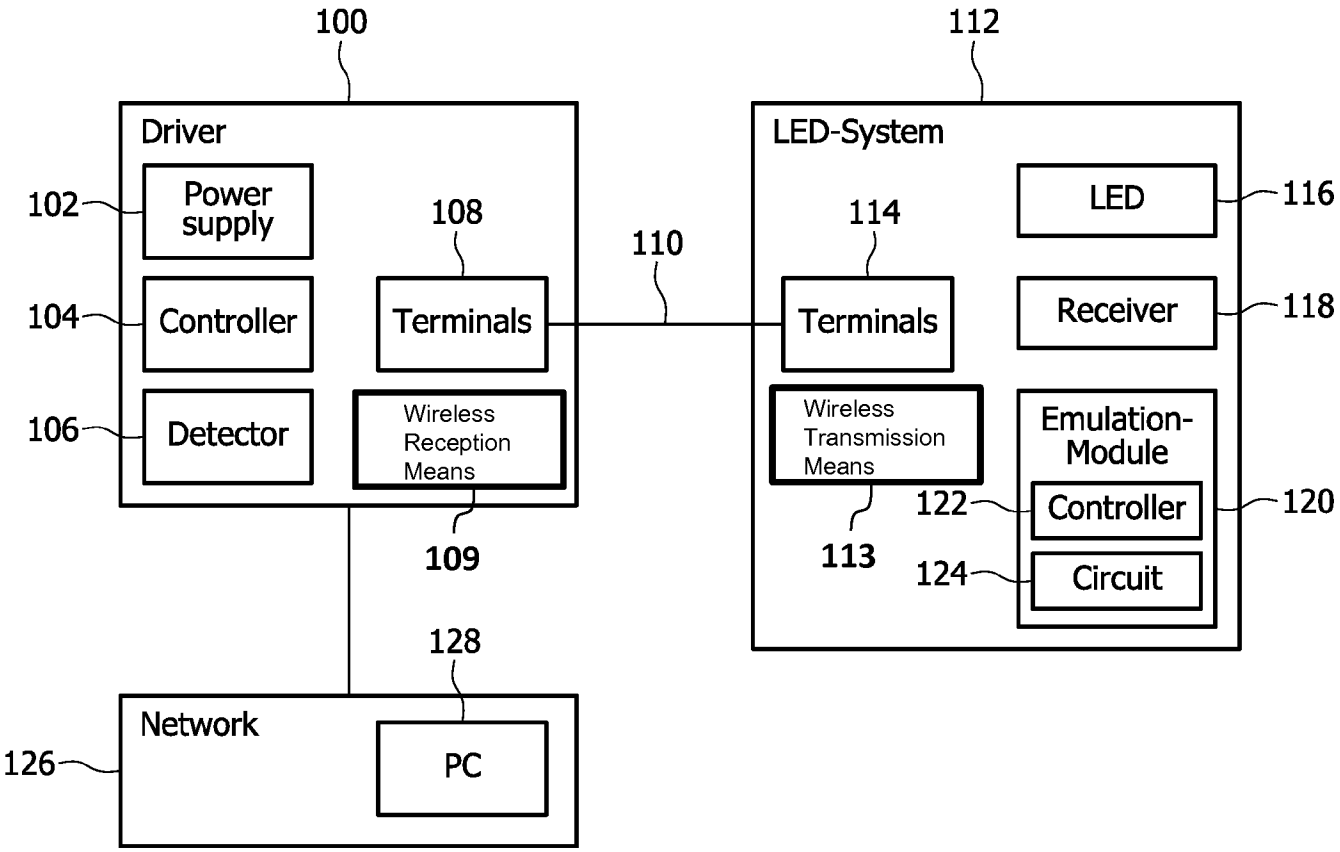
FIG. 1 is a block diagram illustrating a light emitting device system and a driver.

In the following, similar elements are denoted by the same reference numerals.

FIG. 1 is a block diagram illustrating a driver 100 and a light emitting device system 112. The driver comprises a power supply 102 and power supply terminals 108. The light emitting device system comprises power supply terminals 114, wherein the power supply terminals 108 of the driver 100 and the power supply terminals 114 of the light emitting device system 112 are connected by means of a cable 110. Alternatively, instead of a cable other means could be used for the connection 110, e.g. a lighting rail system.

The light emitting device system comprises a solid state light source, which may for example be a conventional light emitting diode (LED) or for example an organic light emitting diode (OLED).

In order to operate the light emitting device system 112, the driver 100 supplies electrical power via the power supply terminals 108, the cable 110 and the power supply terminals 114 to a light emitting diode 116.

The light emitting device system 112 further comprises a remote control signal receiver 118 which may be for example an infrared signal receiver or a radio frequency signal receiver. In case the receiver 118 receives a remote control signal from a remote control signal transmitter not shown in FIG. 1, e.g. a signal indicating a desired light emission characteristic like for example a certain light intensity, the receiver 118 will report this signal to an emulation module 120.

The emulation module 120 comprises a controller 122 and a circuit 124. In the embodiment of FIG. 1, the controller 122 is an active controller comprising for example a processor. The controller 122 may receive the remote control signal from the receiver 118 and recognize a desired adjustment of the light emission intensity by a user.

The controller 122 is further adapted for modulation of the impedance of the light emitting device system 112 via the circuit 124. The modulation of the impedance can be performed prior and/or during operation of the light emitting device system 112 to communicate data to the driver 100. For example, the circuit 124 comprises a controllable resistor, e.g. a MOSFET, wherein the resistance is modulated in accordance with the information to be provided to the driver 100, i.e. the remote control signal information. In the present example, the controller 122 detects a desired change of the light emission intensity, and the controller 122 tunes the circuit 124 for a respective impedance variation in order to communicate the desired change of the light emission intensity as remote control signal information to the driver.

While providing electrical power to the light emitting device system 112, the driver 100 detects the impedance variation of the light emitting device system 112 via the supply terminals 108, the cable 110 and the supply terminals 114. The detection of the impedance variation is performed by means of a detector 106 of the driver 100. In other words, the detector 106 captures the remote control signal information 'change of light emission intensity' by sensing a respectively assigned variation of the electrical load of the light emitting device system 112. In response, a controller 104 of the driver 100 controls the power supplied by means of the power supply 102, depending on the received remote control signal information. For example, the controller 104 may control the power supply 102 to reduce the electrical power supplied to the light emitting device system 112, which will lead to a certain light intensity attenuation of the light emitted by the LED 116 of the LED system 112.

Further illustrated in FIG. 1 is a network 126, which can be for example a superordinate control network. If the network is present, the remote control signal information detected by the driver 100 may also be forwarded to the network 106. If several luminaires are employed comprising different drivers and LED systems with this feature, a distributed remote control receiver can be built. In such a case, the driver may change the signal by including additional information into the forwarded remote control signal information, which allows the control network to determine the driver and hence the location where the signal was received from.

For example, a data processing system like a personal computer (PC) 128 may be part of the network and can be used in real time to display the actually set light emission characteristics of the LED system 112. In case the receiver 118 of the LED system 112 detects a remote control signal that indicates a desired change of the light emission characteristics of the LED 116, this information is provided to the PC 128 via the driver 100 and the network 126. Either the driver may automatically set the desired light emission characteristics of the LED by appropriately adjusting the power supplied via the terminals 108 and 114 to the LED system 112, or the PC 128 may adjust the power supply characteristics of the driver 100.

Nevertheless, in both cases, since a preset and logical relationship exists between received remote control signals and said power supply characteristics, the PC 128 is always able to provide information about the actual light emission characteristics of the LED system 112.

It has to be noted that additionally it is possible to provide the LED system 112 with one or more sensors which may sense the actual operating condition of the LED system 112. Such an operating condition may comprise, without loss of generality, an actual light emission characteristic of the light emitting device system and/or a temperature of the light emitting device system and/or an environmental condition of the environment in which a light emitting device system is being operated and/or a time of operation of the light emitting device system. For this purpose, various kinds of sensors may be used in the light emitting device system 112. These sensors may include for example temperature sensors, sensors which can sense the environmental conditions of the environment in which the light emitting device system is operated, for example a light sensor, humidity sensor, dust sensor, fog sensor or a proximity sensor.

Further, it has to be noted that instead of using the cable 110 and the terminals 108 and 114 to provide the remote control signal information from the LED system to the driver, it is also possible to provide the LED system 112 with means 113 for wireless signal transmission and the driver 100 with means 109 for wireless signal reception. For example, the LED system 112 may transmit the remote control signal information via radio frequency (RF) transmission to the driver 100. Also, optical transmission of information or ultrasonic data transmission is possible, wherein in the latter case preferably the driver 100 and the LED system 112 comprise a common housing through which an ultrasonic coupling is provided In case wireless transmission is used, a requirement to be met is that the transmission characteristics like RF frequency and amplitude are selected in such a manner that undisturbed communication of data from the LED system 112 to the driver 100 is possible, which includes considering possible disturbances like metallic components of the driver 100, shielding by certain driver housing materials and the distance between the driver and the LED system. For example, the receiver 118 may receive an RF remote control signal in a first frequency range and provide respective remote control signal information in a second RF frequency range to the driver 100.

Figure 2:
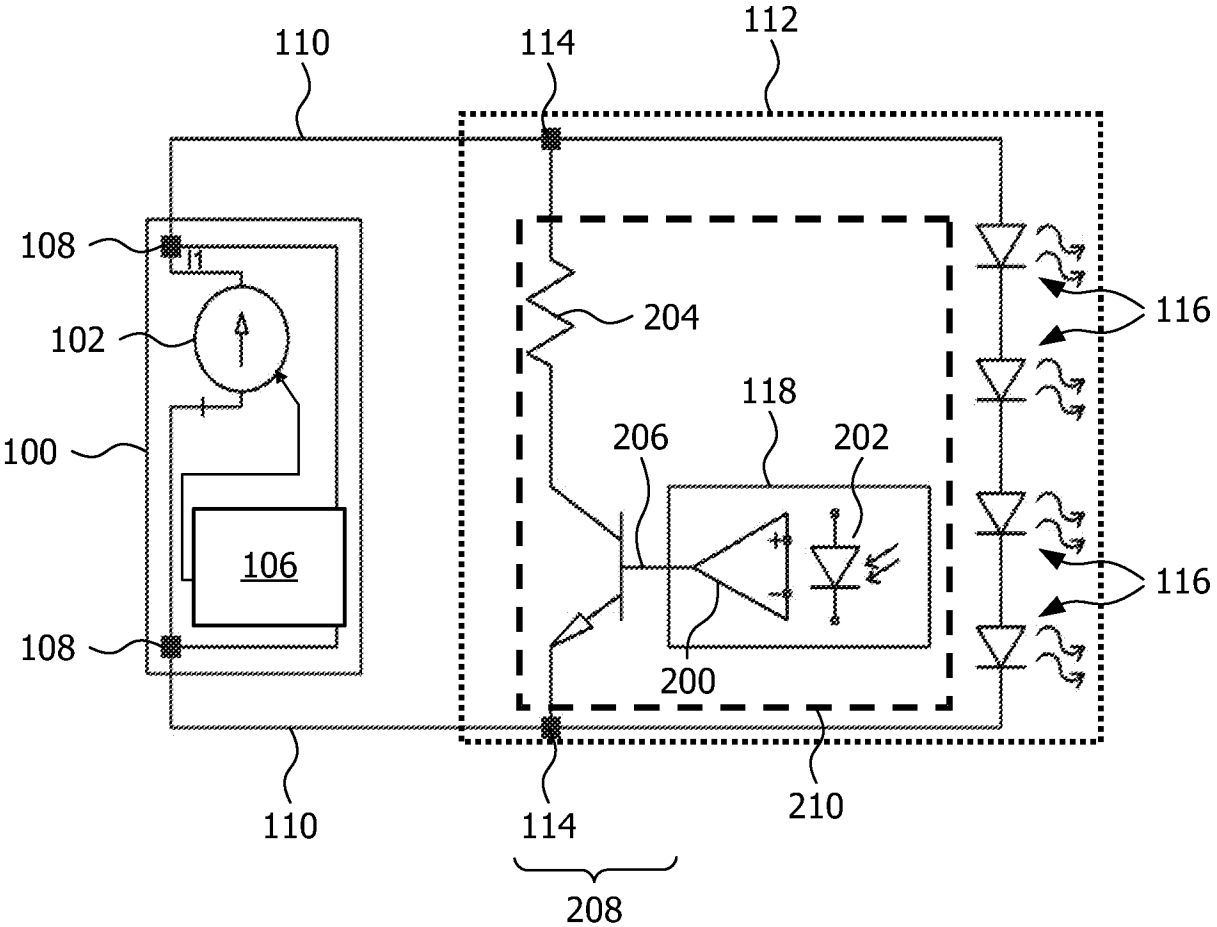
FIG. 2 is a schematic illustrating a circuit diagram of a driver and a light emitting device system.

FIG. 2 is a schematic view of a circuit diagram of the driver 100 and the light emitting device system 112. The driver 100 comprises a current source 102. The light emitting device system 112 comprises a set of light emitting diodes 116 in serial connection with each other. These series-connected diodes form an LED string. The current source 102 and the light emitting diodes 116 are connected via power supply terminals 108 and 114 by means of wires 110 which may also include connectors and respective sockets.

In addition to the light emitting diode string comprising the light emitting diodes 116, the light emitting device system 112 further comprises a circuit 208 which comprises a resistor 204 and a transistor 206. The resistor 204 and the transistor 206 are arranged in series with respect to each other. The circuit 208 is arranged in parallel with the light emitting diode string comprising the LEDs 116. The light emitting device system further comprises a receiver 118 which comprises an infrared sensitive diode 202 and an amplifier 200. In the simple embodiment depicted in FIG. 2, in case a remote control signal, which may be an infrared light in a certain optical wavelength range, is provided to the photodiode 202, the photodiode 202 generates a photocurrent which is amplified by means of the amplifier 200. This amplified signal is provided to the transistor 206 of the circuit 208. In turn, an electrical current can flow from the top power supply terminal 114 of the light emitting device system to the lower power supply terminal 114 of the light emitting device system, thus changing the impedance of the system 112.

In a variant of the structure shown in FIG. 2, it is possible to use an inductor instead of the resistor 204. Then, one or more additional free-wheeling diodes are required to feed the energy stored in the inductor during the activation time of the switch back to the LED string 116. With such an arrangement, the effect of the forwarded remote control signal on the average brightness of the LED string is reduced, since the energy taken from the supply terminal is not dissipated but fed back to the LEDs.

This impedance change can be detected by the detector 106 of the driver 100. In the embodiment depicted in FIG. 2, the detector 106 may use this remote control signal information received via the change of the measured impedance and instruct the power source 102 to adjust the power output characteristics. In this case, the controller 104 of FIG. 1 may be included in the detector 106 or vice versa.

It has to be noted that it is possible that the remote control signal received at the receiver 118 may be translated from one coding scheme into a different format which is better suited for the further handling of the information. For example, it is either possible to perform such a translation in a receiver unit 210, which comprises the receiver 118 and a circuit 208, or it is possible to perform the translation in the detector 106, e.g. it is possible to translate a received RC5 code into a $I^2C$ message.

Figure 3:
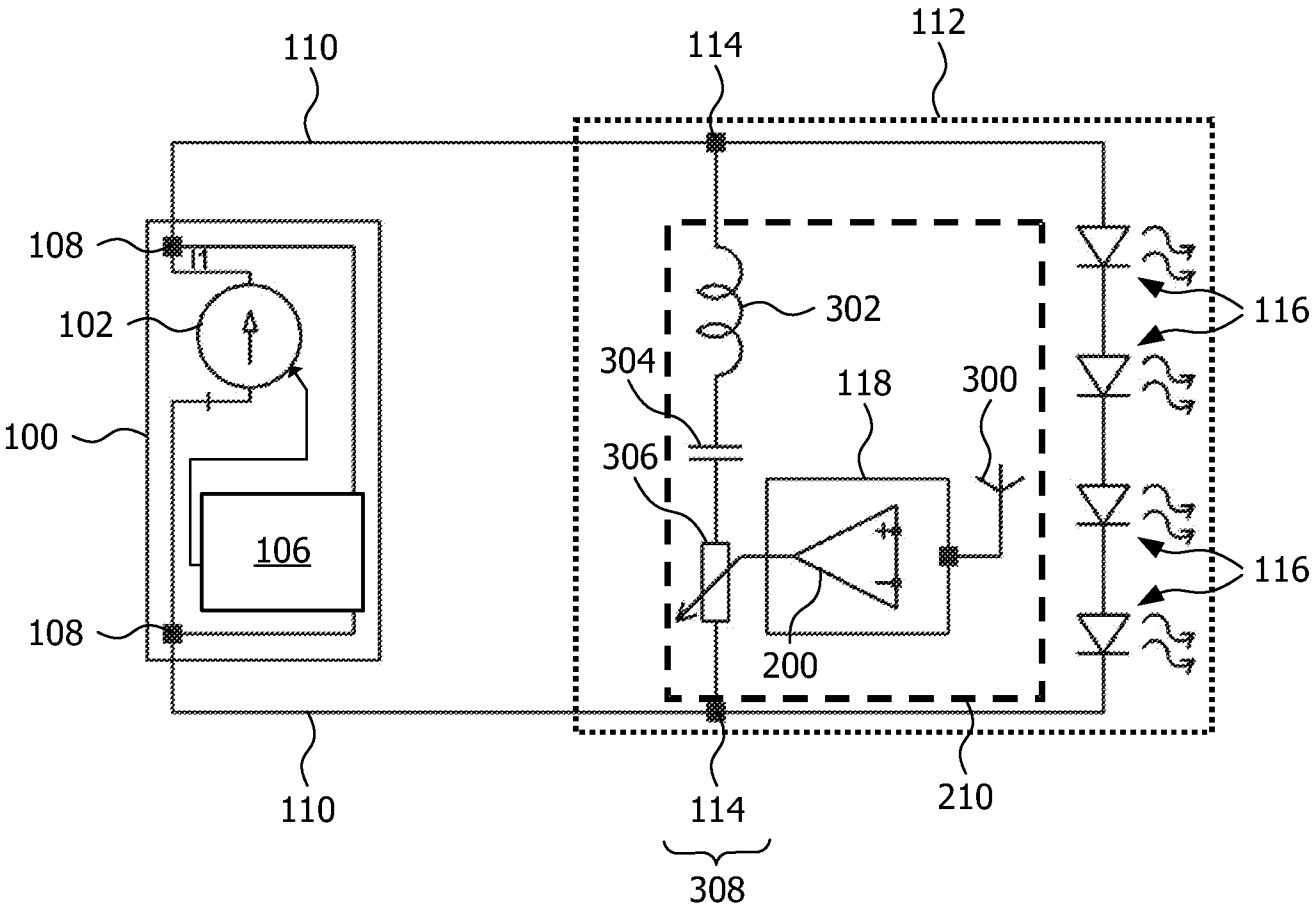
FIG. 3 is a further schematic illustrating a circuit diagram of a further driver and a further light emitting device system.

FIG. 3 is a further schematic view of a circuit diagram of a driver 100 and the light emitting device system 112. Again, the driver comprises a current source 102 and a detector 106, as well as the power terminals 108. The light emitting device system 112 comprises diodes 106 which form an LED string, as already discussed with respect to FIG. 2. The current source 102 and the light emitting diode 116 are connected via the power supply terminals 108 and 114 by means of wires 110.

In addition to the light emitting diode string comprising the light emitting diodes 116, the light emitting device system 112 further comprises a circuit 308. The circuit 308 comprises an impedance 302, a capacitance 304 and a variable resistor 306, which are arranged in series with respect to each other. The circuit 308 is arranged in parallel with the light emitting diode string. The circuit 308 acts as frequency selection circuitry whose impedance can be tuned by means of the variable resistor 306. However, it has to be noted that the circuit 308 may be any circuit which is adapted to emulate a predefined impedance when receiving electrical power with the predefined power signal characteristic, which may for example comprise a certain frequency range as will be further described, without loss of generality, in this example.

In normal steady state DC operation, the circuitry 308 will not influence the power delivered to the light emitting diode string comprising the diodes 116. However, with a dedicated driver 100, the impedance of the circuitry 308 can be detected. For this purpose, the power supply 102 can be switched from DC operation to AC operation via the detector 106, which comprises a respective controller, not shown here. At a certain frequency and voltage amplitude provided as electrical power to the light emitting device system 112, a certain current will flow through the circuitry 308, since the circuitry 308 becomes resonant. By sensing the impedance at one or several discrete frequencies or by sensing the impedance during a frequency sweep or by applying pulses to measure the frequency response, the impedance 'emulated' by the light emitting device system 112 using the circuitry 308 can be detected.

It has to be noted that instead of using a separate detector 106, it is possible to incorporate the detector in a control loop of the power source 102. The modulation of the load will introduce a short term deviation in the LED voltage or current. In case the driver has a closed loop control power supply, the modulation will be present in the error signal of the control loop. As a result, no extra sensing means are required in the driver.

In case the impedance of the receiver unit 210 has to be detected independently of the impedance of the light emitting diode string comprising the diodes 116, the effect of the light emitting diodes may be compensated in the control circuitry of the driver 100. A further solution would be to deactivate the current source and only use a small sensing voltage, which does not reach the forward voltage of the light emitting diode string but is sufficient to sense the electrical load due to the presence of the circuit 308. In such a case, short sensing intervals are preferred to avoid visible artifacts in the light output of the light emitting diode string. Further, such an embodiment is preferred when the light emitting diode system is in the 'off state' and waiting to receive a certain remote control signal, causing it to be powered up to the on state.

A difference between the embodiments of FIGS. 2 and 3 is that in FIG. 2 an IR photodiode 202 is used for detecting a remote control signal, whereas in the embodiment of FIG. 3 an RF antenna 300 is used to receive a respective RF remote control signal.

In the embodiments of FIGS. 2 and 3 it was assumed that remote control signal information is provided via the terminals 108, 114 and the wire 110. However, as already mentioned above, it is also possible to substitute the circuit 208 in FIG. 2 and the circuit 308 in FIG. 3 with wireless data transmission means and to substitute the detector 106 with wireless reception means, which allows transmission of remote control signal information from the LED system 112 to the driver 100 in a wireless manner. Further, it is possible to use a combination of wireless data communication and wired data communication via the terminals 108, 114.

According to the previous embodiments, the remote control signal has a detectable impact when measuring the load between the power terminals of the load, in case information transmission exclusively via the connection terminals 108 and 114 is used. In case of a light emitting diode unit with two power supply terminals, this detectable impact is effective for the current passing through both power supply terminals at the same time, but of opposite polarity, and can be referred to as a differential mode effect.

However, it is also possible for the driver to make use of common mode effects to detect remote control signal information. In such an embodiment, the parasitic capacity of the light emitting diode unit with respect to ground potential is utilized. Such an embodiment could comprise a light emitting diode unit with two power supply terminals and a metal housing for cooling. The receiver in the light emitting diode unit is adapted to influence the coupling between the power supply terminals and the metal housing. To detect information by the driver, which information is received in the light emitting diode unit, the driver will superimpose a certain signal on the power supply terminal, preferably at a high frequency or at a high frequency alternating voltage. In case the receiver has connected one of the power supply terminals to the metal housing, the coupling capacity from the power supply terminal to ground will be higher than in the case that a sensor has disconnected the housing. By measuring the amount of high frequency current flowing through all power supply terminals, the driver can detect if there is a better or worse coupling from the light emitting diode unit towards ground potential.

This measurement allows detecting whether a switch which either connects the housing to or disconnects the housing from one of the power supply terminals is opened or closed and hence provides information about the remote control signal information provided by the light emitting diode unit.

In a more elaborate embodiment not only digital on/off switching but even a gradual increase of the coupling between the power supply terminal and the metal housing can be realized.

According to further options, the power supply terminal is coupled to the metal housing or to other metal parts instead of the metal housing, e.g. an internal metal heat sink inside a light emitting diode system which is encased in a plastic housing, or to other electrically conductive parts like for example a conductive screening layer on the inner side of a plastic housing or an extended copper area on a printed circuit board.

In a variant of FIGS. 2 and 3, the impedance emulating circuitry may be realized differently, e.g. consisting of a capacitor and a resistor, connected across a portion of the light emitting diode string, and being connected in series with the light emitting diodes and consisting of a simple inductor in case of DC driving of the light emitting diodes or a parallel connection of an inductor and/or a resistor and/or a capacitor. In all cases the frequency ranges preferably should be selected appropriately to decouple the 'information portion' from the 'power supply portion' of the load caused by the light emitting diode unit. According to the current stress to the component determining the volume, causes and losses, parallel structures as in FIGS. 2 and 3 are preferred.

Figure 4:
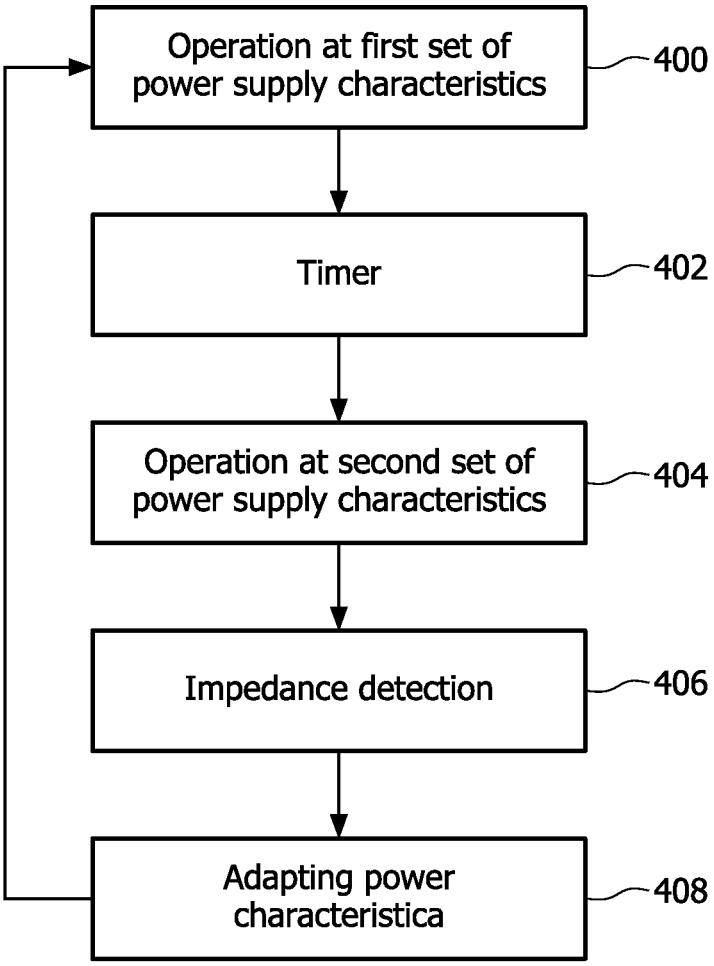
FIG. 4 is a flowchart illustrating a method of operating a light emitting device system and a driver.

FIG. 4 is a flowchart illustrating a method of operating a light emitting diode arrangement consisting of a light emitting device system and a driver. The method starts with step 400 in which the light emitting device system is operated according to a first set of power supply characteristics, being, in the example of FIG. 4, a first frequency. In other words, the driver provides electrical power to the light emitting device system by means of an alternating current of the first frequency. After a certain time has elapsed in step 402, the driver switches for operation at a second set of power supply characteristics, being, in the example of FIG. 4, a second frequency which is different from the first frequency. The light emitting device system comprises an electric circuit which acts as an electrical load with a higher effectiveness when the light emitting device system operates according to the second set of power supply characteristics (404), being, in the example of FIG. 4, the second frequency. However, the circuitry may comprise a switch which can be turned on and off, depending on certain remote control signal information to be provided by the light emitting device system to the driver.

In step 406, the driver senses the electrical load of the light emitting device system by detecting the impedance of the light emitting device system. Depending on the electrical load of the light emitting device system, in step 408 the driver adapts the power characteristics of the electrical power supply to the light emitting device system. The method continues with step 400 by switching to the operation mode in which the first set of power supply characteristics, e.g. the first frequency, is used.

Figure 5A:
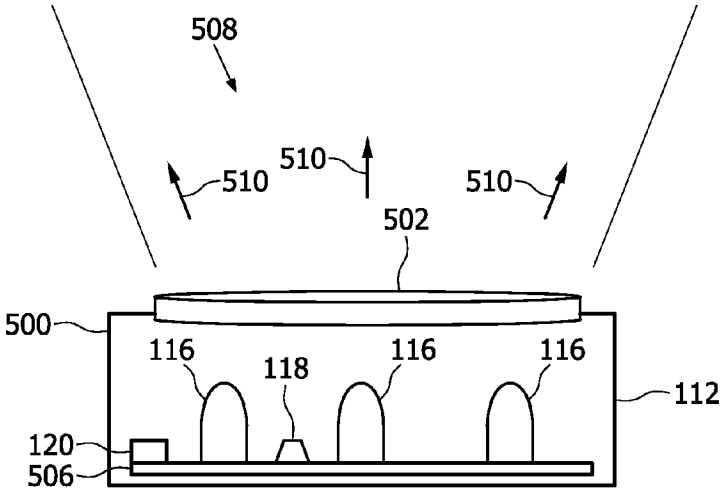
FIG. 5 is a schematic illustrating various light emitting device systems.

FIG. 5 illustrates various schematics of light emitting device systems 112. As shown in FIGS. 5*a, b* and *c*, each light emitting device system comprises a housing 500 which comprises a system board 506. Mounted on the system board 506 are at least one light emitting diode 116 and an emulation module 120. Further, the LED system 112 comprises an optical lens 502 which may be used to concentrate the light emanated from the light emitting diode(s) or to expand the light beam emanated from the light emitting diode(s) 116.

Figure 5B:
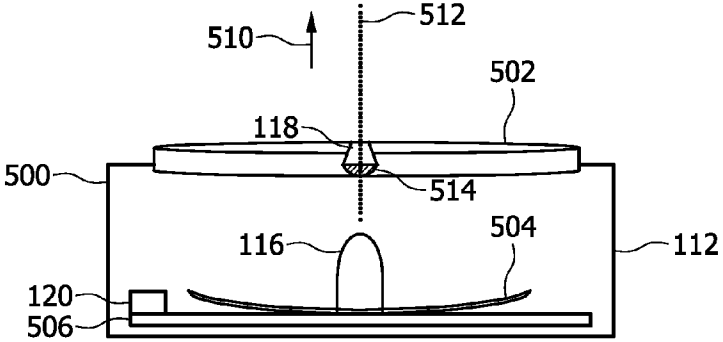
Figure 5C:
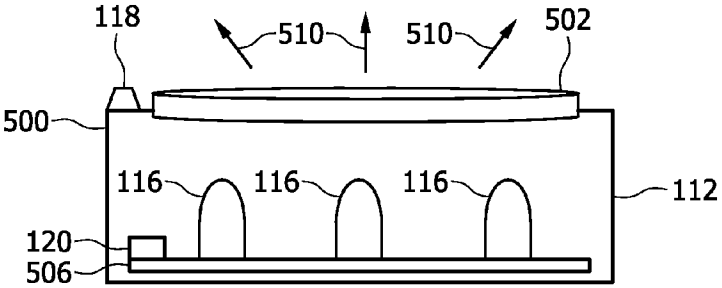

In all embodiments of FIGS. 5*a*, 5*b* and 5*c*, a remote control signal receiver 118 is located in a surface area of the light emitting device system facing in a direction 510 of the illumination beam path of a light cone 508.

It is also possible to have a different orientation of the sensor. E.g. a sensor with omnidirectional sensitivity can be placed on a surface having any orientation, as long as a direct or reflected line-of-sight between the desired remote control transmitter position and the sensor is possible.

In FIG. 5*a*, the remote control signal receiver is mounted on the system board 506 and located between two light emitting diodes 116. As a consequence, the remote control signal receiver is not located in the illumination beam path 510 facing in the direction of the illumination beam path 510. As a consequence, especially in case the receiver 118 is an optical receiver, such as an infrared remote control signal receiver, any IR remote control signal pointing within the light cone 508 towards the light emitting device system 112 will be sensed by the receiver 118. In a more illustrative manner, any object which is illuminated directly by the light emitting device system 112 may be used as transmitter position for a remote control transmitter since, in this case, the remote control transmitter and the receiver 118 are in the direct line of sight.

In the embodiment of FIG. 5*b*, the remote control signal receiver 118 is located in the illumination beam path 510 of the light emitting device system. More precisely, the remote control signal receiver 118 is located on an optical axis 512 of the lens 502. On its rear side facing the LED 116, the remote control signal receiver 118 carries a mirror 514. Light which directly emanates from the LED 116 towards the mirror 514 on the optical axis 512 is reflected towards a parabolic mirror 504 which is arranged on the system board 506 around the LED 116. Since the mirror 504 is a concave mirror, the LED system 112 in combination with the lens 502 can be used for providing a directed and highly parallel beam in the direction 510. At the same time, the remote control signal receiver 118 is always visible for an infrared remote control transmitter, since no shadowing of the receiver 118 by other parts of the LED system 112 takes placet.

In the embodiment of FIG. 5*c*, the remote control signal receiver 118 is located in the surface area of the LED system which faces in the direction 510 of the illumination beam path of the light emitting device system. Here, the remote control signal receiver is mounted to the housing 500, which has similar advantages to the receiver position discussed with respect to FIG. 5*b*.

REFERENCE NUMERALS

100 Driver
102 Power supply
104 Controller
106 Detector
108 Terminals
110 Cable or rail
112 Light emitting device system
114 Terminals
116 Light emitting diode
118 Receiver
120 Emulation module
122 Controller
124 Circuit
126 Network
128 PC
200 Amplifier
202 IR photodiode
204 Resistor
206 Transistor
208 Circuit
210 Receiver unit
300 Antenna
302 Impedance
304 Capacitance
306 Variable resistor
308 Circuit
500 Casing
502 Optical lens
504 Mirror
506 System board
508 Light cone
510 Illumination beam path
512 Optical axis

The invention claimed is:

1. A light emitting device system, comprising:

at least one light emitting device;

power supply terminals connected to receive electrical power from an external driver and to supply the electrical power to the at least one light emitting device;

a remote control signal receiver configured to receive a remote control signal selecting at least one light emission characteristic for the at least one light emitting device; and a circuit configured to provide via the power supply terminals to the external driver remote control signal information indicating the at least one selected light emission characteristic for the at least one light emitting device.

2. The light emitting device system of claim 1, wherein the remote control signal receiver faces in the direction of an illumination beam path of the light emitting device system.

3. The light emitting device system of claim 2, wherein the remote control signal receiver is spatially located in the illumination beam path of the light emitting device system.

4. The light emitting device system of claim 3, wherein the light emitting device system further comprises an optical lens, wherein the remote control signal receiver is located on the optical axis of said lens.

5. The light emitting device system of claim 1, wherein the circuit comprises an emulation circuit connected to the power supply terminals and configured to provide the remote control signal information via the power supply terminals to the external driver by emulating an electrical load of the light emitting device system.

6. The light emitting device system of claim 5, wherein the power supply terminals are configured to sequentially receive electrical power having a first power characteristic, and electrical power having a second power signal characteristic, wherein the emulation circuit is configured to more closely emulate the electrical load when receiving the electrical power having the second power signal characteristic than when receiving the electrical power having the first power signal characteristic.

7. The light emitting device system of claim 5, wherein the emulation circuit is configured to emulate the electrical load of the light emitting device system with respect to a potential which is different from the potential of the power supply terminals.

8. The light emitting device system of claim 5, wherein the emulation circuit comprises a variable resistance device connected across the power supply terminals, the variable resistance device having a control terminal connected to an output of the remote control signal receiver, wherein the remote control signal receiver changes an impedance of the variable resistance device to communicate to the external driver the remote control signal information indicating the at least one selected light emission characteristic for the at least one light emitting device.

9. The light emitting device system of claim 8, wherein the variable resistance device comprises a transistor connected across the power supply terminals.

10. The light emitting device system of claim 8, further comprising a resonant circuit connected in series with the variable resistance device across the power supply terminals.

11. A method, comprising:

receiving, at power supply terminals of a light emitting device system which includes at least one light emitting device, electrical power from an external driver;

supplying the electrical power from the power supply terminals to the at least one light emitting device;

receiving at the light emitting device system a remote control signal selecting at least one light emission characteristic for the at least one light emitting device; and providing remote control signal information indicating the at least one selected light emission characteristic for the at least one light emitting device from the light emitting device system to the external driver via at least one of: (1) the power supply terminals, and (2) wireless transmission.

12. The method of claim 11, including providing via the power supply terminals to the external driver remote control signal information indicating the at least one selected light emission characteristic for the at least one light emitting device.

13. The method of claim 12, wherein the providing via the power supply terminals to the external driver remote control signal information indicating the at least one selected light emission characteristic for the at least one light emitting device includes varying an electrical load of the light emitting device system across the power supply terminals in response to the remote control signal to communicate the remote control signal information to the external driver.

14. The method of claim 13, wherein the varying an electrical load of the light emitting device system in response to the remote control signal includes switching on and off a transistor connected across the power supply terminals to communicate the remote control signal information to the external driver.

15. The method of claim 13, wherein the light emitting device system includes a metal housing wherein varying an electrical load of the light emitting device system in response to the remote control signal includes alternately connecting one of the power supply terminals to the metal housing and disconnecting the one of the power supply terminals to the metal housing.

16. The method of claim 13, wherein the receiving, at the power supply terminals of the light emitting device system, the electrical power from the external driver includes receiving the electrical power at a first frequency in a first time period, and receiving the electrical power at a second frequency in a second time period, wherein the electrical load is varied greater during the second time period in response to the remote control signal than in the first time period to communicate the remote control signal information to the external driver during the second time period.

17. The method of claim 11, including providing via wireless transmission from the light emitting device system to the external driver remote control signal information indicating the at least one selected light emission characteristic for the at least one light emitting device.

18. A method, comprising:

supplying electrical power from a driver to an external light emitting device system via power terminals of the driver;

receiving at the driver, via at least one of: (1) the power supply terminals and (2) wireless reception, remote control information communicated by the external light emitting device to the driver indicating at least one selected light emission characteristic for at least one light emitting device of the external light emitting device system; and the driver employing the remote control signal information to control a parameter of the electrical power supplied from the driver to the external light emitting device system to cause the at least one light emitting device of the external lighting emitting device system to provide the at least one selected light emission characteristic.

19. The method of claim 18, including receiving at the driver, via the power supply terminals, the remote control information communicated by the external light emitting device to the driver indicating at least one selected light emission characteristic for at least one light emitting device of the external light emitting device system.

20. The method of claim 19, wherein the receiving at the driver, via the power supply terminals, the remote control information communicated by the external light emitting device to the driver includes detecting changes in an impedance across the power supply terminals presented by the external light emitting device to the driver.

* * * * *